US008728994B2

(12) United States Patent
Ohira et al.

(10) Patent No.: US 8,728,994 B2
(45) Date of Patent: May 20, 2014

(54) OIL TYPE LUBRICANT FOR FORGING, FORGING METHOD AND SPRAY APPARATUS

(75) Inventors: Hirobumi Ohira, Tokyo (JP); Hitomi Nakamura, Kasugai (JP); Munenori Sugisawa, Toyata (JP); Atsusi Naruoka, Tianjin (JP); Masahiko Tani, Sakai (JP)

(73) Assignees: Aoki Science Institute Co., Ltd., Tokyo (JP); Toyota Jidosha Kabushiki Kaisha, Aichi (JP); Shimano Inc., Osaka (JP)

( * ) Notice: Subject to any disclaimer, the term of this patent is extended or adjusted under 35 U.S.C. 154(b) by 858 days.

(21) Appl. No.: 12/352,687

(22) Filed: Jan. 13, 2009

(65) Prior Publication Data

US 2009/0118149 A1 May 7, 2009

Related U.S. Application Data

(63) Continuation of application No. PCT/JP2008/055460, filed on Mar. 24, 2008.

(30) Foreign Application Priority Data

Mar. 29, 2007 (JP) ..... 2007-089741

(51) Int. Cl.
*C10M 111/02* (2006.01)
*C10M 107/50* (2006.01)

(52) U.S. Cl.
CPC ..... *C10M 111/02* (2013.01); *C10M 2203/1006* (2013.01); *C10M 2203/1025* (2013.01); *C10M 2229/025* (2013.01); *C10N 2220/022* (2013.01); *C10N 2240/402* (2013.01)
USPC ..... 508/207; 508/110

(58) Field of Classification Search
USPC ..... 508/207, 110
See application file for complete search history.

(56) References Cited

U.S. PATENT DOCUMENTS 3,230,750 A 1/1966 Horbury et al.
3,287,264 A 11/1966 Topper
4,178,260 A * 12/1979 Cook et al. ..... 508/162
4,834,891 A 5/1989 Eguchi et al.

(Continued)

FOREIGN PATENT DOCUMENTS

EP 1818119 A1 8/2007
JP 60-1293 A 1/1985

(Continued)

OTHER PUBLICATIONS

Pentaerythritol Tetraoleate product data, retrieved from the internet at <http://www.made-in-china.com/showroom/richardfu129/product-detailcqtxsBEGRTrA/China-Pentaerythritol-Tetraoleate-CAS-19321-40-5-.html> on Oct. 12, 2011.*

(Continued)

*Primary Examiner* — James Goloboy
(74) *Attorney, Agent, or Firm* — Baker & Hostetler LLP

(57) ABSTRACT

An oil type lubricant for forging, which is featured in that the flash point thereof is confined to the range of 70-170° C., the kinematic viscosity thereof at 40° C. is confined to the range of 4-40 $mm^2/s$ and that it contains neither water nor an emulsifier. A forging method and a spray apparatus wherein the above-described oil type lubricant is used.

7 Claims, 3 Drawing Sheets

(56) References Cited

U.S. PATENT DOCUMENTS

| | | | | |
|---|---|---|---|---|
| 6,401,800 | B1 * | 6/2002 | Guetelbauer et al. | 164/465 |
| 6,589,919 | B2 * | 7/2003 | Fukunaga et al. | 508/113 |
| 2006/0089268 | A1 * | 4/2006 | Stewart et al. | 508/110 |
| 2007/0131140 | A1 * | 6/2007 | Aoki et al. | 106/38.22 |

FOREIGN PATENT DOCUMENTS

| | | | |
|---|---|---|---|
| JP | 1-299895 | A | 12/1989 |
| JP | 01315493 | A | 12/1989 |
| JP | 2003-053468 | A | 2/2003 |
| JP | 2006-182806 | A | 7/2006 |
| JP | 2007-9020 | A | 1/2007 |
| WO | 1999/03956 | A1 | 1/1999 |
| WO | WO 2006/025368 | A1 | 3/2006 |
| WO | WO 2006025368 | A1 * | 3/2006 |

OTHER PUBLICATIONS

Edenor PTO (pentaerythritol TetraOleate) data sheet, retrieved from the internet at <http://www.products.cognis.com/cognis/prodleafR2.nsf/($ProductsbyDocID_PL-Header)/REF27EB8B2BEFEABAB085256ADB0052EFD5/$file/AGNIQUE_PET_181TT_E.pdf> on Oct. 12, 2011.*

Ryusuke Izawa et al., "Development of next-generation Water Free Die Lubricant and small amount spray application, Die Casting", 2005, No. 122, p. 7-14.

Hirobumi Ohire et al., "Quality and Performance Features of next Generation type Water Free Mold Release Agent", Alutopia, Jun. 2007, vol. 37, No. 6, pp. 29-39.

* cited by examiner

OIL TYPE LUBRICANT FOR FORGING, FORGING METHOD AND SPRAY APPARATUS

CROSS-REFERENCE TO RELATED APPLICATIONS

This is a Continuation application of PCT Application No. PCT/JP2008/055460, filed Mar. 24, 2008, which was published under PCT Article 21(2) in Japanese.

This application is based upon and claims the benefit of priority from prior Japanese Patent Application No. 2007-089741, filed Mar. 29, 2007, the entire contents of which are incorporated herein by reference.

BACKGROUND OF THE INVENTION

1. Field of the Invention

The present invention relates to an oil type lubricant to be sprayed on the occasion of forging non-ferrous metals such as aluminum, magnesium, zinc and alloys thereof or iron. Further, the present invention relates to a forging method using the oil type lubricant and to a spray apparatus.

2. Description of the Related Art

As well known, forging is a technique for deforming a metallic material to be commercialized by means of compression. This technique can be generally classified into two types, i.e., a hand forging and die forging. One good example of the hand forging may be represented by a sword which can be manufactured through the beating of an ironic material. On the other hand, the die forging is carried out by making use of a mold for homogenizing the products to be produced. One good example of the die forging is the crankshaft constituting one component of engine. Further, in order to lower the compression force required for the deformation of a metallic material, a material to be forged (hereinafter referred to as a workpiece) may be heated to soften the workpiece. The temperature for heating the workpiece may differ depending on the material constituting the workpiece. Although the forging can be classified, depending on the magnitude of heating, into cold forging, warm forging and hot forging, there is no clear numerical definition.

The cold forging is performed at a temperature of lower than the recrystallization temperature (room temperature in general) of a workpiece and the dimensional accuracy of the workpiece is very high. Accordingly, there are large possibilities that the workpiece can be commercialized without necessitating any post-work treatment. The cold forging can be suitably applied to manufactures of small products. The hot forging is performed at a temperature of higher than the recrystallization temperature of a workpiece and can be suitably applied to manufactures of large products. However, the hot forging is accompanied with problems that an oxide layer is caused to form on the surface of the workpiece and that the cracking of the product tends to be produced by the enlargement of crystal grain.

Since the metal constituting a workpiece is caused to deform in the forging, the workpiece is compressed at a high pressure. In a situation where there is no lubricant between a workpiece and a mold, galling or agglutination may occur between the workpiece and the mold. Therefore, in order to prevent these galling and agglutination, a lubricant is used for the mold.

Generally, in the case of the cold forging, a film of lubricant is more likely to be created due to the physical adsorption of the lubricant. On the other hand, in an environment of high temperatures in the hot forging, the lubricant can hardly adhere to the workpiece due to Leidenfrost's phenomenon (a kind of bumping) of lubricating components. Further, even if the lubricant is enabled to adhere to the workpiece to some extend, the absorptivity thereof is weak resulting in a difficulty in forming a firm lubricating film. In the case of the lubricant where water is employed as a medium, if the temperature of forging is lower than 100° C., water cannot be easily dried up, thereby making it difficult to form a lubricating film. However, when the temperature of forging is raised to an intermediate temperature, the lubricating film can be easily formed. Generally, lubricants to form a film can be classified into the following types.

1) Graphite film: Two kinds of lubricant film, i.e., an aqueous emulsion type and an oil type dispersion type.

2) White powder: An aqueous emulsion type of mica, boron nitride or melamine cyanurate.

3) Glass type: A mixture of colloidal silica and alkaline metal salt of aromatic carboxylic acid (Jpn. Pat. Appln. KOKAI Publication No. 60-1293), which will be diluted with water.

4) Water-soluble polymer type: Water is contained therein (Jpn. Pat. Appln. KOKAI Publication No. 1-299895).

Graphite exhibits excellent lubricity throughout temperatures ranging from low to high temperature levels. However, graphite is accompanied with a problem that the working environment will be stained with black powder, creating bad environments. Especially, in the case of a lubricant wherein graphite is mixed with oil, it would become a cause for bringing about a badly stained environment. In the case of a lubricant wherein white powder is contained as a major powder component, the working environment may not be so badly stained as compared with graphite. However, when the content of white powder is relatively large, the working site would be stained as well. Moreover, the white powder is inferior in lubricity as compared with graphite. Furthermore, if the white powder is relatively high in hardness, the surface of mold would be damaged, thus tending to shorten the useful life of the mold.

Although the glass-type and the polymer-type lubricants are useful in forming a thick film, the lubricity thereof is inferior as compared with graphite and may shorten the useful life of the mold. Furthermore, in the use of these lubricants, a glass film or a polymer film is caused to be formed on a portion around a forging apparatus, thereby necessitating a step of cleaning and hence degrading the working efficiency even though the cleaning step may not be so troublesome as in the case of the white powder.

Further, since the graphite-based and the white powder-based lubricants are dispersed in water or in oil, these lubricants are always accompanied with a problem of separation during the storage thereof or with a problem of clogging on the occasion of spraying these lubricants. In the case of water-glass-based lubricant, the dry up of the lubricant occurs in the vicinity of a spray nozzle. Especially when the interruption of work is prolonged, the dry up of the lubricant is promoted giving rise to the clogging of the nozzle. As a result, the quantity of spray would be decreased at the time of resuming the spraying work. Therefore, since the lubricating capability becomes insufficient, defective forging would result. Although the aqueous-emulsion-type lubricant is excellent in mold-cooling properties, it will necessitate a waste-water treatment.

When the inner surface of mold is heated higher than 200° C., the mist of lubricant enveloped by water layer would be boiled up on the inner surface of mold. As a result, the adhesive efficiency of the lubricant to the mold would be degraded, thus necessitating the spray of a large quantity of the lubricant. Namely, since the formation of the water-soluble lubricant film depends largely on the forging temperature, it is imperative to severely control the temperature of the mold.

Since water cannot be evaporated at a temperature lower than 100° C., the emulsion-type lubricant is unsuitable for use in the cold forging. This emulsion-type lubricant however is useful in the warm or hot forging. However, in the case of this emulsion-type lubricant, the mold is cooled by water but heated by a workpiece. When this heating/cooling cycle is repeated, cracks are generated in the mold. As a result, the mold is required to be repaired and when the number of this repair is increased, the mold which is expensive is required to be discarded. Namely, the useful life of the mold is shortened by water. Further, because the lowering of the workpiece temperature is prominent during the molding process, a high pressure molding would be required, which is one of the factors to shorten the useful life of the mold.

With respect to the spraying method, there is a problem that the cycle time is prolonged due to a large amount of spray. In the case of the water-soluble lubricant, since a large quantity of the lubricant is required to be sprayed, it is not preferable in terms of production efficiency. Additionally, due to the scattering of the lubricant resulting from a large quantity of spraying of the lubricant, there will be raised various problems such as the degrading of the working environment and the increase of frequency for replenishing the lubricant. Furthermore, the heating step of a workpiece may cause the lowering of productivity. The production process using the conventional water-soluble lubricant includes various steps after the temperature rise of the workpiece. For example, they include three steps such as a rough molding step, a finish molding step and a preliminary molding step. In this case, since the temperature of the workpiece is caused to become lower concurrent with the proceeding of molding step, the deformation resistance is caused to increase thus making it difficult to mold the workpiece. Especially, in the case of the water-soluble lubricant, since the quantity of spraying is relatively large, the mold is cooled and hence the lowering of the workpiece temperature is accelerated. In order to cope with this problem, a step of re-increasing the temperature is sometimes incorporated in the manufacturing process of the workpiece. However, the step of re-increasing the temperature leads to the increases of cycle time, working space, running cost, etc., resulting in the degrading of production efficiency.

BRIEF SUMMARY OF THE INVENTION

As described above, the conventional lubricants are accompanied with problems summarized as follows.

1) In the case of a water-glass-type lubricant, the clogging of a spray nozzle may occur, thereby decreasing the quantity of spraying the lubricant. Because of this, the forged product to be obtained may become non-uniform in quality.

2) In the case where graphite is employed as a lubricant, the working environment may be stained with black powder.

3) In the case where a water-soluble lubricant is employed, a large quantity of the water-soluble lubricant may be required to be sprayed. Therefore, the production efficiency may be degraded and, at the same time, the useful life of mold may be decreased and the working environment may be degraded.

4) A step of re-increasing the temperature is incorporated in the molding process of the workpiece, the production efficiency may be degraded.

The present invention has been accomplished in view of overcoming the aforementioned problems and hence the major object of the present invention is to provide a water-free type lubricant for forging which is capable of minimizing the non-uniformity in quality of forged products that may be caused by the decrease of spraying quantity of the lubricant due to the clogging of the nozzle.

Other objects of the present invention are to provide a forging method and a spray apparatus, both making it possible to carry out the spray of a lubricant at a smaller quantity as compared with the conventional method and apparatus, to enhance the production efficiency, to prolong the useful life of the mold and to inhibit the degrading of the working environment.

(1) The oil type lubricant for forging according to the present invention is featured in that the flash point thereof is confined to the range of 70-170° C., the kinematic viscosity thereof at 40° C. is confined to the range of 4-40 $mm^2/s$ and that it contains neither water nor an emulsifier.

(2) The oil type lubricant for forging of the present invention according to paragraph 1 is characterized in that it comprises: (a) 60-90 mass % of solvents having a kinematic viscosity of 2-10 $mm^2/s$ at 40° C. and a flash point of 70-170° C.; (b) 1-5 mass % of mineral oils and/or synthetic oils having a kinematic viscosity of 50 to less than 100 $mm^2/s$ at 40° C.; (c) 1-5 mass % of ester base oils having a kinematic viscosity of not less than 200 $mm^2/s$ at 40° C.; (d) not more than 15 mass % of silicone oils having a kinematic viscosity of not less than 150 $mm^2/s$ at 40° C.; and (e) 5.1-10 mass % of additives exhibiting a lubricity.

(3) The oil type lubricant for forging of the present invention according to paragraph 1 or 2 is characterized in that it further comprises 0.1-3 mass % of wettability improvers.

(4) The oil type lubricant for forging of the present invention according to paragraph 2 or 3 is characterized in that it further comprises an antioxidant.

(5) The oil type lubricant for forging of the present invention according to paragraph 4 is characterized in that the antioxidant is contained at a ratio of 0.2-2 mass % and is formed of one or more kinds of antioxidants selected from the group consisting of an amine-based antioxidant, a phenol-based antioxidant and a cresol-based antioxidant.

(6) The oil type lubricant for forging of the present invention according to any of paragraphs 2 to 5 is characterized in that it further comprises 1-5 mass % of lipophilicity-imparted white powders.

(7) The forging method according to the present invention is featured in that the forging is carried out using the aforementioned oil type lubricant for forging.

(8) The spray apparatus according to the present invention is featured in that it comprises a delivering system for spraying an oil type lubricant for forging to a mold; a delivery condition-controlling system which is electrically connected with the delivering system and designed to control the quantity of the oil type lubricant to be delivered from the delivering system; and a temperature control system for controlling the temperature of the mold.

A. The oil type lubricant for forging having the features of paragraphs 1 and 2 is enabled to exhibit the following effects.

A-1) Since the oil type lubricant contains no water, it is possible to expect the following effects (a to c).

a. There is no possibility of giving rise to Leidenfrost's phenomenon, resulting in excellent in adhesive efficiency. As a result, it is possible to carry out a small quantity spraying.

b. Since there is no possibility of giving rise to the quenching action in a mold, the useful life of the mold can be prolonged.

c. Since water is not required to be drained, it is not necessary to treat waste water.

A-2) Because of the small quantity spraying, the cooling of the mold can be minimized. Therefore, the temperature drop of the workpiece in a situation, where a large number of molding steps are required to be performed, can be minimized. As a result, the step of re-increasing the temperature would be no longer required and the production efficiency can be greatly enhanced.

A-3) Since the lubricant is highly volatile, there is little possibility that the lubricant sags and runs from the surface of mold, thus indicating high adhesive efficiency. A component which is effective at high temperatures can be adhered in a great amount onto the surface of mold, thereby making it possible to secure a high-temperature lubricity. As a result, it is possible to minimize the galling or agglutination in the mold, thus contributing to the improvement of production efficiency.

A-4) Since graphite is not contained in the lubricant, it is possible to maintain an excellent working environment.

B. When the oil type lubricant further comprises a wettability improver as indicated in the paragraph 3, it is possible to further enhance the adhesive efficiency of the lubricant. As a result, it is possible to promote the aforementioned small quantity spraying.

C. When the oil type lubricant further comprises an antioxidant as indicated in paragraphs 4 and 5, it is possible to retard the degradation of the lubricant at high temperatures. As a result, it is possible to use the lubricant at a higher temperature, thus enhancing the high-temperature durability of the lubricant. Therefore, since the initial temperature of the mold can be increased, it is possible to expect the following effects.

C-1) In a multiple step situation, the load required in a subsequent step can be lowered, thereby making it possible to prolong the useful life of the mold.

C-2) The step of re-increasing the temperature of mold in a middle of process can be omitted, thus improving the production efficiency.

D. When the oil type lubricant further comprises the lipophilicity-imparted white powder as indicated in paragraph 6, it is possible to further enhance the high-temperature durability of the lubricant. As a result, the effects mentioned in paragraph C can be further enhanced.

E. By the utilization of the forging method of paragraph 7, the effects mentioned in paragraphs A-D can be obtained.

F. By the employment of the spray apparatus of paragraph 8, it is possible to carry out the lubricant spray under excellently controlled conditions. As a result, it is possible to further ensure more reduced spraying of the lubricant.

DETAILED DESCRIPTION OF THE INVENTION

Figure 1:
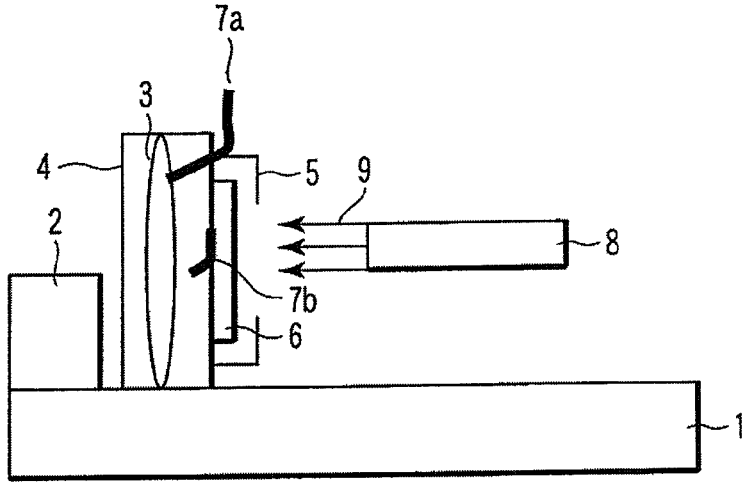
FIG. 1 schematically illustrates the spray apparatus for measuring the quantity of adhesion, wherein a sequence of spraying process is illustrated.

Next, the present invention will be further explained with reference to specific embodiments.

(1) In claim 1, it is described that "an oil type lubricant for forging, which is featured in that the flash point thereof is confined to the range of 70-17° C., the kinematic viscosity thereof at 40° C. is confined to the range of 4-40 $mm^2/s$ and that it contains neither water nor an emulsifier". The reasons for defining the invention will be explained in the following items (1-1) to (1-3).

(1-1) The reason for limiting the flash point to the range of 70-170° C. is as follows.

In order to form a thick oil type film on the inner surface of a mold, it is desirable to enable a component that has been once adhered to the surface of the mold to quickly evaporate as in the case of a quick-drying paint, thereby preventing the sags and runs of the lubricant from the mold. Therefore, it is more preferable to employ a lubricant which is faster in evaporation rate. However, when the evaporation rate is too high, it may give rise to Leidenfrost's phenomenon, which is liable to occur when a water-soluble lubricant is employed. Therefore, such a high evaporation rate as that of gasoline is not preferable. Further, if the evaporation is too fast, the flash point is lowered, thereby increasing the possibility of fire. Since the flash point (70° C.) of automotive diesel fuel is considered practical, the flash point of the composition according to the present invention is set to not less than 70° C.

(1-2) The reason for limiting the kinematic viscosity at 40° C. to the range of 4-40 $mm^2/s$ is as follows.

Namely, when the kinematic viscosity is less than 4 $mm^2/s$, the viscosity of the lubricant would become too low, giving adverse effect on the wearing durability of a spray pump. Further, when the kinematic viscosity is higher than 40 $mm^2/s$, it may become difficult to appropriately spray the composition due to an increased viscosity of the lubricant.

(1-3) The main reason for limiting the lubricant to such that it contains neither water nor an emulsifier is due to the fact that since water itself is incapable of exhibiting lubricity. Water is useless for lubrication. Rather, water brings about a number of obstacles to the lubricity. Thus, the problem of Leidenfrost's phenomenon can be overcome by eliminating water. As a result, the adhesive efficiency can be enhanced, thereby making it possible to ultimately realize small quantity spraying. Leidenfrost's temperature for water is around 150-200° C., at which water boils, resulting in the degrading of adhesive efficiency. On the other hand, the Leidenfrost's temperature of an oil type lubricant is as high as 150° C. or so, indicating excellent adhesive efficiency of the lubricant even in a high temperature. Because of this, the quantity of spray can be reduced, thereby making it possible to prolong the useful life of the mold. Furthermore, since drainage is not required, it is possible to greatly minimize the environmental load.

(2) In claim 2, it is described that the oil type lubricant for forging comprises: "(a) 60-90 mass % of solvents having a kinematic viscosity of 2-10 $mm^2/s$ at 40° C. and a flash point of 70-170° C.; (b) 1-5 mass % of mineral oils and/or synthetic oils having a kinematic viscosity of 50 to less than 100 $mm^2/s$ at 40° C.; (c) 1-5 mass % of ester base oils having a kinematic viscosity of not less than 200 $mm^2/s$ at 40° C.; (d) not more than 15 mass % of silicone oils having a kinematic viscosity of not less than 150 $mm^2/s$ at 40° C.; and (e) 5.1-10 mass % of additives exhibiting a lubricity". The reasons for defining the oil type lubricant will be explained in the following items (2-1) to (2-4).

(2-1) Component (a) is a highly volatile/low viscosity component, so that it vaporizes at the surface of mold. Incidentally, a solvent exhibiting a strong polarity such as alcohol, ester, ketone, etc. should not be used as component (a) in view of the influence thereof on human body. It is preferable to employ a petroleum-based solvent which is weak in polarity and mostly constituted by saturated components or to employ a low viscosity mineral oil. Preferable examples of component (a) include a saturation-type solvent which is highly refined with sulfur content being limited to not more than 1 ppm or a synthetic oil with low viscosity.

The reason for limiting the kinematic viscosity at 40° C. to the range of 2-10 $mm^2/s$ in component a is as follows.

Namely, when the kinematic viscosity is less than 2 $mm^2/s$, the viscosity of the lubricant as a whole is caused to become too low, giving adverse influence to the wearing durability of a spray pump. Further, when the kinematic viscosity is higher than 10 $mm^2/s$, the viscosity of the lubricant as a whole is caused to become too high, thus making it difficult to appropriately spray the composition. The reason for limiting the mixing ratio of component (a) to the range of 60-90 mass % is to optimize the volatile property of the lubricant. Meanwhile, in the case of a mold which is high in temperature, it is preferable to employ a lubricant exhibiting a higher flash point in order to inhibit the evaporation of the lubricant. In this case however, the viscosity of the lubricant may become higher. When the viscosity of the lubricant is too high, the spraying performance of the lubricant may be degraded. Therefore, the upper limits of the flash point and the viscosity of the lubricant are confined to as described above.

Incidentally, the aforementioned mixing ratio of 60-90 mass % of component (a) may further include mineral oils of low viscosity and/or synthetic oils with low viscosity in addition to the solvent. Further, when component (a) is constituted by only a solvent, the solvent may be constituted by two or more kinds of solvents.

(2-2) The mineral oil and/or the synthetic oil having a kinematic viscosity of 50 to less than 100 $mm^2/s$ at 40° C., which constitutes component (b), as well as the ester base oil having a kinematic viscosity of not less than 200 $mm^2/s$ at 40° C., which constitutes component (c), is enabled to adhere to the surface of the mold after the spray thereof. As a result, these components are effective in increasing the thickness of the lubricant film at a temperature region ranging from room temperature to 300° C., thereby enabling these components to a role of sustaining the lubricant film. Especially, the ester base oil is excellent in oxidation stability and hence capable of sustaining the oil type film even under high temperatures. Above mentioned component is required to have such a sufficient degree of viscosity at the actual temperature of the mold at where the sprayed lubricant does not cause sags and runs during a time period of several seconds after spraying the lubricant and before the pouring of a molten metal into the mold.

Assuming that an average temperature of the entire surface of the mold is 150° C., the kinematic viscosity of a mixture of components (b) and (c) is expected to become not less than 100 $mm^2/s$ at 40° C. Further, if the mixing amount of component (b) and component (c) is too small, the lubricant film would become too thin on the mold surface. Conversely, if this mixing amount is too large, it may bring about the unstable spray due to the rise in viscosity of the lubricant and also may bring about the stiff adhesion of the lubricant (spot coloring problem) onto the surface of a forged product. In order to cope with these problems, the mixing ratio of component (b) is limited to 1-5 mass % and the mixing ratio of component (c) which is excellent in oxidation stability is also limited to 1-5 mass %. Specific examples of component (h) include, for example, petroleum-based mineral oil, synthetic oil and cylinder oil. Specific examples of component (c) include, for example, dieter, triester, trimellitate ester and complex ester.

(2-3) The silicone oil constituting component (d) is employed for securing the lubricity at high temperatures and is limited to not more than 15 mass % of silicone oils having a kinematic viscosity of not less than 150 $mm^2/s$ at 40° C. Component (d) also easily adheres onto the surface of mold, thereby sustaining the lubricity at a high temperature of about 250-400° C. Since component (d) is also expected to sustain the lubricity thereof at a higher temperature region than that can be sustained by components (b) and (c), the kinematic viscosity of component (d) should preferably be not less than 150 $mm^2/s$ at 40° C.

With respect to the silicone oil constituting component (d), it may be any kind of silicone oils available in the market such as dimethyl silicone. However, some kinds of silicone oil tend to be inadequate to paint coating for molded products, so that dimethyl silicone may not be preferred depending on the quantity of spraying. In the case that the paint coating is required for molded products, it is preferable to employ, as silicone oil, alkyl silicone oil having alkyl aralkyl group or alkyl group having a longer chain than that of dimethyl, for example. The reason for the limitation of not more than 15 mass % is that if the content of silicone oil is larger than 15 mass %, silicone or decomposed matters of silicone may deposit on the surface of mold, thereby giving bad influences to the configuration of forged part. Incidentally, if the mold is to be used at a low/medium temperature (lower than 250° C.), an additive exhibiting lubricity may be added as component (e). Therefore, silicone oil may not necessarily be employed. However, in the case of molding at high temperatures (250° C. or more), it is required to employ silicone oil which can be hardly decomposed at such high temperatures.

(2-4) The additive exhibiting lubricity and constituting component (e) is employed for securing the lubricity at a low/medium temperature. Specific examples of this additive include animal and vegetable fats such as rapeseed oil, soybean oil, coconut oil, palm oil, lard, etc.; monohydric or polyhydric alcohol esters of higher fatty acid such as fatty acid ester, fatty acid of coconut oil; organic acids such as oleic acid, stearic acid, lauric acid, palmitic acid, etc; organic molybdenum; oil-soluble soap; oil wax; etc. As for the organic molybdenum, it is preferable to employ, for example, MoDDC and MoDTC. MoDDP or MoDTP is not preferable due to a possible reaction between aluminum of molten metal and phosphorus in the components. With respect to the oil-soluble soap, it is possible to employ sulfonates, phenates and salicylates of Ca or Mg. Further, with respect to the oil-soluble soap, it is also possible to employ metal salts of organic acids even thought they are poor in solubility.

(3) Claim 3 contains the limitation that the oil type lubricant further comprises 0.1-3 mass % of wettability improvers. It is possible to improve the adhesive efficiency by enhancing the wettability of a mold. With respect to this wettability improver, following chemicals can be raised as examples; acrylic copolymer or acryl-modified polysiloxane having a flash point of not more than 100° C. If the content of the wettability improver is less than 0.1 mass %, it would show almost no effect. Even if the content of the wettability improver is increased to more than 3 mass %, the intended effect thereof would not be significantly enhanced.

(4) Claim 4 contains the limitation that the oil type lubricant further comprises antioxidants. The effect of these antioxidants is to retard the degrading of the oil film for several seconds. However, if the forging can be accomplished within this short period of time, it is possible to achieve the oxidation-preventing effect thereof. It is possible, through a suitable combination a composition which is capable of withstanding high temperatures and a small quantity spray, to raise the initial temperature of a workpiece on the occasion of preliminary molding step. As a result, since the temperature of the workpiece during the main molding process can be kept higher, it is possible to eliminate with the step of re-increasing the temperature.

With respect to specific examples of these antioxidants, one or more kinds of materials can be selected from the group consisting of amine-based, phenol-based or cresol-based antioxidants.

With respect to specific examples of the amine-based antioxidant, they include monoalkyldiphenyl amine-based antioxidant such as monononyldiphenyl amine; dialkyldiphenyl amine-based antioxidant such as 4,4'-dibutylphenyl amine, 4,4'-dipentyldiphenyl amine, 4,4'-dihexyldiphenyl amine, 4,4'-diheptyldiphenyl amine, 4,4'-dioctyldiphenyl amine, 4,4'-dinonyldiphenyl amine, etc.; polyalkyldiphenyl amine-based antioxidant such as tetrabutyldiphenyl amine, tetrahexyldiphenyl amine, tetraoctyldiphenyl amine, tetranonyldiphenyl amine, etc.; α-naphthyl amine, phenyl-α-naphthyl amine, butylphenyl-α-naphthyl amine, pentylphenyl-α-naphthyl amine, hexylphenyl-α-naphthyl amine, heptylphenyl-α-naphthyl amine, octylphenyl-α-naphthyl amine, etc.

With respect to specific examples of the phenyl-based antioxidant, they include, for example, 2,6-di-tert-butyl-4-methylphenol, 2,6-di-tert-butyl-4-ethylphenol, 4,4-methylenebis(2,6-di-tert-butylphenol), 2,2-methylenebis(4-ethyl-6-butylphenol), macromolecular monocyclic phenolic, polycyclic tertiary butyl phenol, burylated hydroxytoluene (BHT), burylated hydroxyanisole (BHA), etc.

With respect to specific examples of the cresol-based antioxidant, they include, for example, di-tertiary butyl paracresol, 2,6-di-tertiary butyl amino-p-cresol, etc.

Among these antioxidants, a mixture comprising BHT and alkyldiphenyl amine-based antioxidant is more preferable.

(5) Claim 6 contains the limitation of lipophilicity-imparted white powders. The reason for this limitation is that seizing can be prevented by the use of white powder in the lubricant, even after the disappearance of oily matters and the antioxidant. However, when powder is mixed with the oil type lubricant, sedimentation is more likely to occur. By imparting lipophilicity to the powder, it is possible to prevent this sedimentation. With respect to specific examples of this powder, they include, for example, organic clay, calcium carbonate modified with a fatty acid and pumice. The reason for limiting the content of this component to 1-5 mass % is that if the quantity of this powder is too small, the seizing-preventing effects thereof can be hardly expected but if the quantity of this powder is too large, the sedimentation thereof may be caused to occur. Furthermore, as the content of the white powder is increased, the contamination of the working environment would become more prominent.

(6) In the present invention, optional additives may be blended in the lubricant such as a rust preventive, a surfactant, an anti-corrosion agent, a defoaming agent and other kinds of additives (for example, an extreme-pressure additive, a viscosity index improver, a cleaning dispersant, a coloring agent, a perfume).

(7) Claim 8 describes that "a spray apparatus comprises a delivering system for spraying an oil type lubricant for forging to the mold, the oil type lubricant being selected from those claimed in claims 2 to 6; a delivery condition-controlling system which is electrically connected with the delivering system and designed to control the quantity of the oil type lubricant to be delivered from the deliver system; and a temperature control system for controlling the temperature of the mold". In spraying this small-quantity of lubricant composition which is developed by the present invention, the needed quantity of the lubricant can be decreased to about 1/10 to 1/20 of the spray quantity of the conventional water-soluble lubricant. Therefore, the delivering system should have a spray portion for atomizing the lubricant using a spray nozzle with small diameter which is suited for spraying a small amount of lubricant. By making it possible to achieve this small quantity-spraying, the productivity can be improved due to the shortened cycle time, the degrading of the working environment can be prevented, and the frequency of replenishing the lubricant can be reduced. Because of not only the formulation of the lubricant, but also the improvement of spray method, it is now made possible to realize the small quantity-spraying. Further, in order to enhance the accuracy of the small quantity-spray and to form a uniform oil film by preventing an excessive spray of the lubricant to the mold, the lubricant spray should be performed according to the following method.

(7-1) The delivering system should have a needle valve for on and off. As a result, it is possible to enable the lubricant to accurately reach to the portions of mold where the lubricant spray is required. In addition to the small amount spray resulted from the lubricant formulation, the optimization of the spraying method leads to minimization of the lubricant splash into air atmosphere. Additionally, since the spraying velocity can be increased, the productivity can be also enhanced.

(7-2) The delivery condition-controlling system has a system for adjusting the state of spraying by making use of liquid pressure and pilot air pressure. This system is designed such that a workpiece can be delivered in the apparatus immediately after the accomplishment of the spraying. As a result, due to the reduction of spraying time and the reduction of the timing for charging the workpiece, the cycle time can be shortened, thereby further making it possible to improve the production efficiency. It is also possible to increase the velocity of movement by changing a robot teaching program for delivering, for example.

(7-3) The temperature control system can control the temperature of the mold through measuring the mold temperature with a thermocouple and a cartridge heater which is buried in the mold. Especially when the temperature of the mold at the preliminary molding step is set to 200-250° C., which is about 100° C. higher than the conventional temperature, it is possible to keep the temperature of a workpiece at a higher level in subsequent process, thereby making it possible to reduce the molding load and to eliminate the step of re-increasing the temperature. As a result, it is now possible to enhance the production efficiency.

EXAMPLES

Next, the present invention will be explained with reference to specific examples and comparative examples. It should be appreciated that the present invention is not only limited to the formulation of oil type die cast lubricant but also applicable to the lubricants for squeezing process.

(A) Manufacturing Method:

First of all, a high-viscosity mineral oil, silicone oil, rapeseed oil, organic molybdenum, a wettability improver and an antioxidant were introduced into a stainless steel tank at a ratio (% by mass) described in the following Table 4. Then, the components were heated to 40° C. and stirred for 30 minutes. Thereafter, a solvent was added to the resultant mixture at a ratio (% by mass) described in the following Table 4. The resultant mixture was further stirred for 10 minutes to manufacture an oil type lubricant.

(B) Measurement of Flash Point:

The flash point was measured according to Pensky-Martens method of JIS-K-2265.

(C) Method of Measuring the Viscosity:

The viscosity at 40° C. was measured according to JIK-2283.

(D) Method for Measuring the Quantity of Adhesion:

(D-1) Preparation:

An iron plate (SPCC, 100 mm×100 mm×1 mm thick) used as a test piece is baked in an oven for 30 minutes at the temperature of 200° C. Thereafter, the iron plate was left to cool overnight in a desiccator and the mass of the iron plate was measured to an accuracy of 0.1 mg.

(D-2) Spraying of an Oil Type Release Agent:

FIG. 1 shows a spray apparatus for measuring the quantity of adhesion. The reference number 1 in FIG. 1 indicates the table of the adhesion testing machine. A power source/temperature controller 2 is mounted on a portion of this table 1. An iron frame 4 having a heater 3 inside is mounted on the table 1 and close to the power source/temperature controller 2. An iron plate-supporting fitment 5 is secured to one side wall of the iron frame 4. A test piece (iron plate) 6 is positioned inside the iron plate-supporting fitment 5. Two thermocouples, 7*a* and 7*b*, are buried in the vicinity of the heater 3 and the thermocouples 7*a* and 7*b* are contacted with the heater 3 and the plate-supporting fitment 5, respectively. It is designed that a release agent 9 is sprayed from a spray nozzle 8 toward the iron plate 6.

The operation of the spray apparatus shown in FIG. 1 can be performed as explained below.

First of all, the power source/temperature controller 2 of the spray apparatus (Yamaguchi Giken Co., Ltd.) is set to a predetermined temperature and the iron plate-supporting fitment 5 is heated by means of the heater 3. When the thermocouple 7*a* is reached up to a set temperature, the iron plate 6 used as a test piece is placed on the iron plate-supporting fitment 5 and the thermocouple 7*b* is contacted steadily with the iron plate 6. Subsequently, when the temperature of iron plate 6 is reached to a predetermined temperature, a predetermined quantity of the release agent 9 is sprayed from the spray nozzle 8 toward the iron plate 6. Thereafter, the iron plate 6 is picked up, erected vertically and allowed to cool in an air atmosphere for a predetermined period of time. The oil components that flow down from the iron plate 6 are squeezed away.

(D-3) Method for Measuring the Quantity of Adhesion:

The iron plate 6 with adhered matter thereon is placed in the oven at a predetermined temperature and for a predetermined period of time. Thereafter, the iron plate 6 is picked up and air-cooled and further allowed to cool for a predetermined period of time in a desiccator. Thereafter, the mass of iron plate 6 with adhered matter thereon is measured to an accuracy of 0.1 mg and the quantity of adhered matter is calculated based on the blank test and a change in mass of the test piece.

(D-4) Conditions for the Test:

The conditions for the test are illustrated in the following Table 1.

TABLE 1

| | Conditions |
|---|---|
| Quantity of coating (mL) | 0.3 |
| Spraying time (sec.) | 1 |
| Liquid pressure (MPa) | 0.005 |
| Air pressure (MPa) | 0.3 |
| Distance of spray gan (mm) | 150 |
| Temperature of iron plate (° C.) | 150, 250, 350 |
| Drying of iron plate after test | 200° C., 30 min. |

Figure 2A:
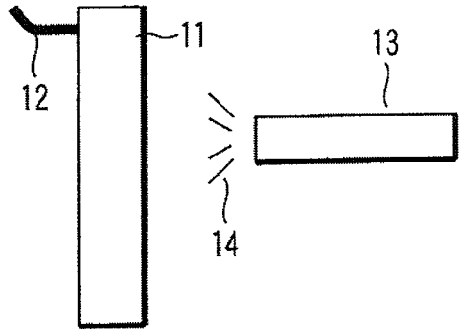
FIG. 2A is a diagram illustrating a spraying step as one steps in the method of measuring the frictional force of a test piece.
Figure 2B:
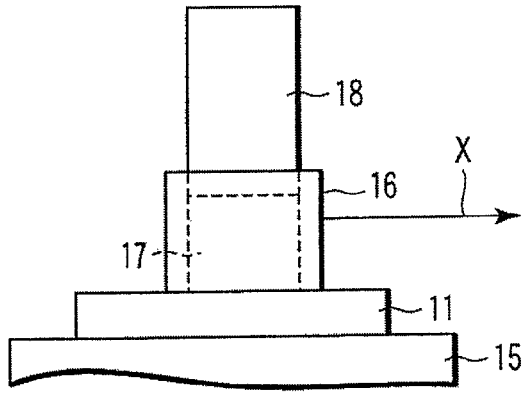
FIG. 2B is a diagram illustrating the other step in the method of measuring the frictional force of a test piece.

(E) Method for Measuring the Frictional Force:

(E-1) Method of Testing the Friction:

FIGS. 2A and 2B illustrate the order of steps in the method of measuring the frictional force of the test piece. The operating method of the friction test is as follows. An iron plate (SKD-61; 200 mm×200 mm×34 mm) 11 for measuring the friction of an automatic tension tester (MEC International Co., Ltd.) is equipped with a built-in thermocouple 12. This iron plate 11 is heated by making use of a heater which is available in the market. When this thermocouple 12 is actuated to indicate a predetermined temperature, the iron plate 11 for measuring the friction is erected vertically. Then, under the conditions described in the aforementioned adhesion test, a release agent 14 is sprayed from a spray nozzle 13.

Then, the iron plate 11 for measuring the friction is immediately placed horizontally on a tester trestle 15 as shown in FIG. 2B. Further, a ring (MEC International Co., Ltd.; S45C; 75 mm in inner diameter, 100 mm in outer diameter and 50 mm in height) 16 is placed on a central portion of the iron plate 11. Then, 90 mL of molten aluminum (ADC-12; temperature: 670° C.) 17, which has been melted in advance in a fusion furnace for ceramics, are poured in the ring 16. Subsequently, the molten aluminum 17 is allowed to cool in an air atmosphere for 40 seconds and to solidify. Immediately thereafter, an iron weight having a weight 18 of 8.8 kg (a total weight thereof together with the molten aluminum is 10 kg) is gently placed on this solidified aluminum (ADC-12) and then the ring 16 is pulled in the direction of X indicated by an arrow to thereby measure the frictional force of the solidified aluminum.

(E-2) Conditions for Measuring the Frictional Force:

The conditions for the spraying are the same as those of Table 1. The conditions for measuring the frictional force are as shown in the following Table 2.

TABLE 2

| | |
|---|---|
| Load | 10 Kg (a total of ring, aluminum and weight) |
| Contacting area | 44.2 $cm^2$ (cross-sectional area of the ring) |
| Pulling velocity | 1 cm/sec. |

(F) Friction Test Under a High Pressure: Ring Compression Test

Figure 3A:
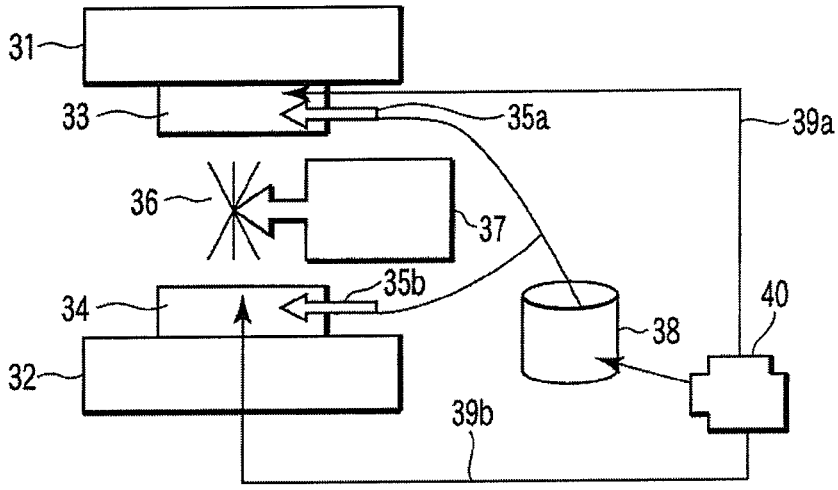
FIG. 3A is a diagram schematically illustrating an entire structure of the spray apparatus according to the present invention.
Figure 3B:
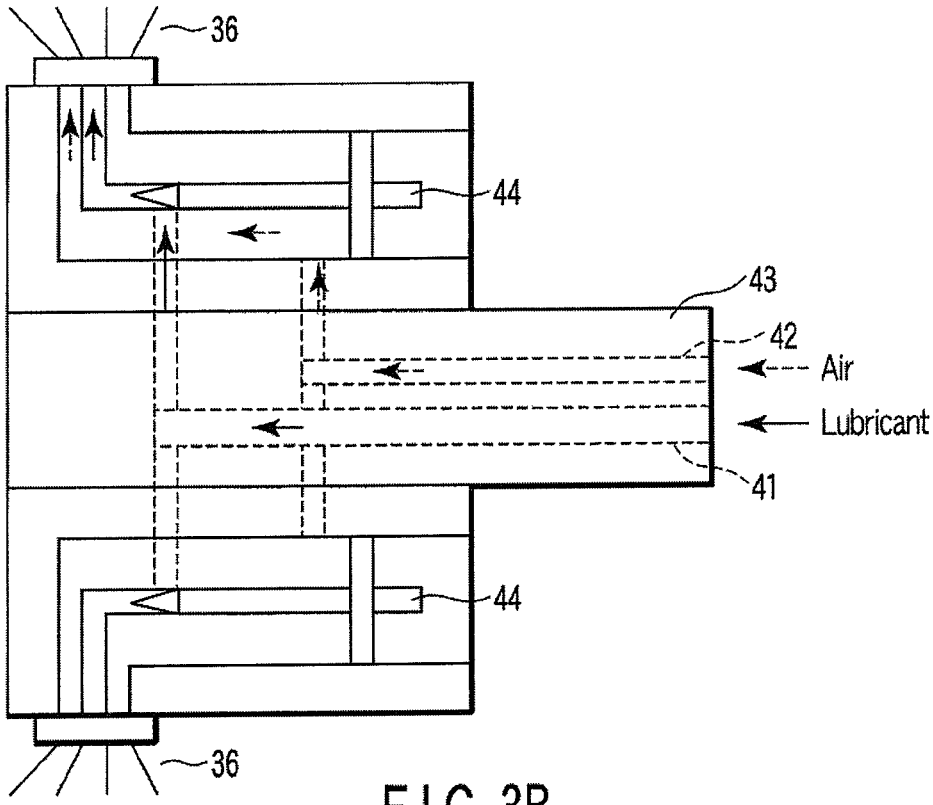
FIG. 3B is a enlarged view of a spray unit constituting the spray apparatus shown in FIG. 3A.
Figure 3C:
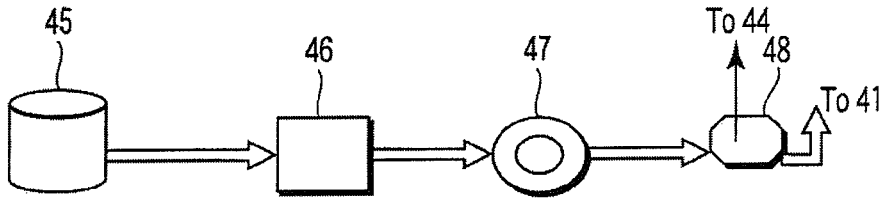
FIG. 3C is a diagram for illustrating the flow of a lubricant in the spray apparatus shown in FIG. 3A.

FIGS. 3A-3C are diagrams schematically illustrating the ring compression test.

(F-1) Testing Method:

This testing method is based on the ring compression test which is described in the document (Plasticity and Work; Vol-18, No. 202, 1977-11) provided by the cold forging branch/warm forging study group of Japan Society for Technology of Plasticity.

(F-2) Conditions for the Test:

The conditions for the test were as shown in the following Table 3.

TABLE 3

| Items | Conditions: see (G-3) | Conditions: see (G-4) |
|---|---|---|
| Compression ratio | 50 ± 10% | 60 ± 2 |
| Inner dia. of ring | 10 mm | 30 mm |
| Temp. of punch | 250 ± 20° C. | 175 ± 25° C. |
| Temp. of work | 480° C. | 450° C. |
| Quantity of Spraying | 0.6 ml | 1.5 ml (Ex.)<br>30.0 ml (Comp Ex.) |
| Spraying time | 0.3 sec. | 0.5 sec. (Ex.)<br>3 sec. (Comp. Ex.) |

(G) Components and the Results Measured in the Test:

The following Table 4 shows the compositions of Examples 1-4 and Comparative Examples 1-3 and the results measured in the adhesion and friction tests.

(G-1) Results of Measurement-1: Adhesion and Friction Test: Comparison Under the Same Spray Conditions:

In Table 4, Examples 1, 2 and 3 are related respectively to an oil type lubricant for forging, Comparative Examples 1 and 2 are related to water-soluble lubricants for forging, and Comparative Example 3 is related to an oil type lubricant for forging. When Examples 1, 2 and 3 are compared with Comparative Examples 1 and 2 in terms of the quantity of adhesion which was obtained from the same quantity of spraying, it will be recognized that in the case of Examples 1-3, the quantity of adhesion was on a level of 9-15 mg at 350° C. but in the case of Comparative Examples 1 and 2, the quantity of adhesion was on a level of zero, thus indicating a significant difference. Namely, while it was possible to form a thick oil film in the case of Examples, it was only possible to form a thin oil film in the case of Comparative Examples. As a result, as shown in the friction test, in the case of Examples, it was possible to prevent seizing even at 350° C. In the case of Comparative Example 1 however, seizing was observed at

TABLE 4

| | Ex. 1 | Ex. 2 | Ex. 3 | Ex. 4 | Comp. Ex. 1 | Comp. Ex. 2 | Comp. Ex. 3 |
|---|---|---|---|---|---|---|---|
| Types | Oily | Oily | Oily | Oily | Water-soluble *14 | Water-soluble *15 | Oily *16 |
| Composition (%) | | | | | | | |
| Solvent *1 | 80.5 | 67.3 | 75.7 | 76.6 | — | — | 89.0 |
| Mineral oil *2 | 3 | 11 | 3 | 3 | — | — | 0 |
| High-viscosity mineral oil*3 | 0 | 0 | 0 | 0 | — | — | 5.0 |
| Ester base oil *4 | 4 | 4 | 4 | 4 | — | — | — |
| Silicone TN *5 | 5.8 | 5.8 | 0 | 0 | — | — | 5.0 |
| Silicone 1H *6 | 0 | 0 | 2.2 | 5 | — | — | — |
| Rapeseed oil *7 | 1.5 | 1.5 | 5.6 | 1.5 | — | — | 0.5 |
| Organic molybdenum *8 | 0.6 | 1.2 | 2.4 | 1 | — | — | 0.5 |
| Extreme-pressure agent *9 | 1.5 | 4.3 | 2.2 | 2 | — | — | — |
| Oil-soluble metal soap *10 | 1.7 | 1.7 | 1.7 | 1.7 | — | — | — |
| Wettability improver *17 | 0.2 | 2 | 2 | 2 | — | — | — |
| Antioxidant A *11 | 0.6 | 0.6 | 0.6 | 0.6 | — | — | — |
| Antioxidant F *12 | 0.6 | 0.6 | 0.6 | 0.6 | — | — | — |
| Organic clay *13 | 0 | 0 | 0 | 2 | | | |
| Physical properties | | | | | | | |
| Flash point (° C.) | 93 | 91 | 92 | 92 | — | — | 93 |
| Viscosity, 40° C. ($mm^2/s$) | 5 | 7 | 6 | 9 | — | — | 5 |
| Adhesion test (mg), 0.3 mL sprayed | | | | | | | |
| 350° C. | 8.8 | 15.1 | 12.1 | 22 | 0 | 0.4 | 5.3 |
| 300° C. | 10.5 | 22.0 | — | 26 | 0 | 0.7 | 7 |
| 250° C. | — | — | 20.1 | 29 | 1.3 | 2.6 | 9.3 |
| 200° C. | — | — | 20.0 | — | 1.7 | 4.0 | 9.8 |
| Friction test (Kgf), 0.3 mL sprayed | | | | | | | |
| 350° C. | 4.3 | 4.3 | 4.4 | 4.2 | Seizing | Seizing | 4.5 |
| 250° C. | 5.0 | 5.4 | 4.7 | 4.0 | Seizing | 6.8 | 4 |
| 200° C. | 3.4 | 3.4 | — | — | 6.9 | 5.6 | 3.5 |
| 150° C. | — | — | 3.7 | 4.8 | — | — | 3.0 |

In Table 4

*1: Petroleum-based solvent: Shellsole TM (trade name; Shell Chemicals Japan)

*2: Mineral oil: Jomo 500SN (trade name of paraffin base oil; Japan Energy Co., Ltd.)

*3: High-viscosity mineral oil: Jomo Bright Stock (trade name of paraffin base oil; Japan Energy Co., Ltd.)

*4: Ester base oil: Priolube 2046 (trade name; Uniqema Co., Ltd.)

*5: Silicone TN: Release agent TN (trade name; Wacker Asahi Kasei Co., Ltd.)

*6: Silicone 1H: Wacker AK-10000 (trade name; Wacker Asahi Kasei Co., Ltd.)

*7: Rapeseed oil (Meito Yushi Industries Co., Ltd.)

*8: Organic molybdenum (MoDTC): Adeka 165 (trade name; Asahi Denka Kogyo Co., Ltd.)

*9: Extreme-pressure agent: ester sulfide type Dailuve GS-230 (trade name; Dainihon Ink Co., Ltd.)

*10: Oil-soluble metal soap: Infinium M7101 (trade name; Infinium Co., Ltd.)

*11: Phenol-based antioxidant: Rusmit BHT (trade name; Daiichi Kogyo Pharmaceuticals Co., Ltd.)

*12: Amine-based antioxidant: HiTEC 569 (trade name; Afton Chemicals Co., Ltd.)

*13: Garamite 1958: (trade name; Southern Cray Products Co., Ltd.)

*14: TMC-1001A (trade name; water-glass type; Evenkeel Co., Ltd.): a liquid diluted with 20 times of water.

*15: WF: Whitelub (trade name; water-glass type; Taihei Kagaku Industries): a liquid diluted with seven times of water.

*16: WFR-3R (trade name; Aoki Science Institute Co., Ltd.): an oil type lubricant for forging which was manufactured by the present applicant.

*17: Wettability improver: EFKA-3778 (trade name; Wilbur Eris Co., Ltd.)

300° C. and in the case of Comparative Example 2, seizing was observed at 350° C. The oil type lubricants of these Examples were enabled to adhere at a large quantity so that it is now possible to form a thick oil film and to inhibit seizing, thus indicating excellent properties as compared with the water-soluble lubricant.

(G-2) Results of Measurement-2: Adhesion and Friction Test: Comparison Under the Same Quantity of Effective Components:

Table 5 shown below indicates the spray quantity of the lubricants of Example 3 and of Comparative Examples 1 and 2 as well as the results of friction test.

TABLE 5

| | Ex. 3 | Comp Ex. 1 | Comp Ex. 2 |
|---|---|---|---|
| Quantity of Spraying (mL) | 0.3 | 6.0 | 2.1 |
| Magnification of dilution | Undiluted liquid | 20 | 7 |
| Effective component (mass %) | 22.8 | 21.4 | 21.1 |
| Effective component sprayed (g) | 0.063 | 0.063 | 0.063 |
| Adhesion test (mg) | | | |
| 350° C. | 8.8 | 2.0 | 2.8 |
| 300° C. | 10.5 | 3.1 | 5.1 |
| Friction test (Kgf) | | | |
| 350° C. | 4.3 | Seizing | 6.2 |
| 300° C. | 4.6 | Seizing | 6.2 |

The compositions of Example 3 and of Comparative Examples 1 and 2 are the same as those shown in Table 4. In the case of Comparative Examples, the lubricant was diluted before use at the working site of forging. The quantity of adhesion and the frictional force shown in Table 4 are compared between Comparative Examples with dilution and Example with no dilution. For fair comparison, lubricant evaluation was made under the condition of "the same amount of effective components", not "the same amount of spray" which is as seen in the working site. In the case of Comparative Example 1, since the lubricant was formed of a 7 times dilution, seven times in spraying quantity of the lubricant was used. In the case of Comparative Example 2, since the lubricant was formed of a 20 times dilution, 20 times in spray quantity of the lubricant was used. Then, these sprayings of Comparative Examples 1 and 2 were compared with the 0.3-mL spray of undiluted lubricant of Example 3. The results obtained are shown in Table 5.

On the quantity of adhesion, Comparative Example 1 was of a level of 3 mg and Comparative Example 2 was of a level of 4 mg, indicating very low level as compared with a level of 9 mg of Example 3. With respect to the frictional force, Comparative Example 1 exhibited seizing and Comparative Example 2 was of a level of 6 kgf. In the case of Example 1, the frictional force was as low level as 4-5 kgf. Even in the comparison with the same quantity of effective components, Example 3 was found superior than Comparative Examples 1 and 2 in terms of the quantity of adhesion and the frictional force.

(G-3) Results of Measurement-3: Ring Compression Test-1: Comparison Between the Oil Type Lubricant and the Water-Soluble Lubricant:

Table 6 shown below shows the results of measurement in the ring compression test of Comparative Examples 2, 3 and 4.

TABLE 6

| | Comp. Ex. 2 | Comp. Ex. 3 | Comp. Ex. 4 |
|---|---|---|---|
| Types | Water-soluble | Oily | No lubricant |
| Composition | See Table 4 | See Table 4 | — |
| Friction coefficient, average | 0.167 | 0.095 | 0.4 |

Figure 4:
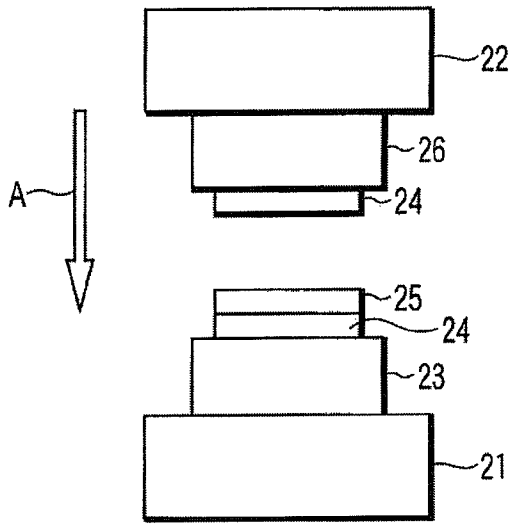
FIG. 4 is a diagram schematically illustrating a ring compression test.

FIG. 4 is a diagram schematically illustrating the ring compression testing machine. Reference numbers 21 and 22 represent a lower die set and an upper die set, respectively. A die 23 is disposed on the lower die set 21 and a test piece 25 is placed on a lubricant film 24, which is on the die 23. A punch (upper side) 26 is disposed on the underside of the upper die set 22 and the lubricant 24 is sprayed to the underside of the punch 26.

By making use of the ring compression testing machine constructed as described above, the friction under a high pressure was evaluated. The outline of testing is that the lubricant 24 is sprayed to the underside of the punch 26 which is fixed to the upper die set 22. The lubricant 24 is also sprayed to the die 23 which is fixed to the lower die set 21 and then a test piece 25 is placed thereon. Subsequently, a pressure is applied in the direction of arrow A to thereby deform the test piece 25. A frictional coefficient is read out from the reduction ratio of the inner diameter of the deformed test piece 25. Although they are all comparative examples, Comparative Example 3 is the oil type lubricant of which formulation is close to the lubricant of Examples (see Table 4). When no lubricant is sprayed in the composition, the frictional coefficient becomes as high as 0.4. However, in the case of Comparative Example 2 for a water-soluble lubricant, the frictional coefficient was as low as 0.167. In the case of Comparative Example 3 for oil type lubricant, the frictional coefficient was as low as 0.095. Although the lubricants of Examples were not tested under these conditions, it can be assumed that an oil type lubricant is deemed to be effective in view of the results of Comparative Example 3 for the oil type lubricant.

(G-4) Results of Measurement-4: Ring Compression Test-2: Examples and Comparative Examples:

Table 7 below shows the results of measurement in the ring compression test of Example 3 and Comparative Examples 1, 2 and 4.

As shown in the above Table 3, the frictional coefficient was examined under more severe conditions (the compression ratio was increased from 50% to 60% and the inner diameter of the ring was also increased from 10 to 30 mm) than the conditions of paragraph G-3. The frictional coefficient 0.11 of the comparative Example for a water-soluble lubricant was almost the same level as 0.12 of Example for oil type lubricant.

TABLE 7

| | Ex. 3 | Comp. Ex. 1 | Comp. Ex. 2 | Comp. Ex. 4 |
|---|---|---|---|---|
| Types | Oily | Water-soluble | Water-soluble | No lubricant |
| Friction coefficient, average | 0.12 | 0.11 | 0.11 | 0.58 |

(G-5) Results of Measurement-5: Evaluation with Actual Machine-A:

Table 8 below shows the results of measurement of Examples 3 and 4 and Comparative Example 2.

TABLE 8

| | Ex. 3 | Ex. 4 | Comp. Ex. 2 |
|---|---|---|---|
| Quantity of spraying, 7 times dilution (mL) | — | — | 58 |
| Quantity of spraying undiluted liquid (mL) | 3.2 | 5.4 | — |
| Effective component (mass %) | 22.8 | 24.8 | 21.1 |
| Effective component in spraying liquid g (calculate) | 0.73 | 1.33 | 1.22 |
| Average real load (KN) | 1665 | 1679 | 1667 |
| Average work thickness (mm) | 44.1 | 44.7 | 42.6 |

With the actual machine-A of the present applicant, the lubricity was evaluated in an upset-bend molding step (preliminary molding). The conditions in this evaluation for Table 8 were as follows: the temperature of mold: 250-280° C.; load-set value: 1600KN; workpiece temperature: 470-490° C.; and material: A6061 alloy.

The general structure of the spray apparatus of the present invention which was used in this evaluation was as shown in FIGS. 3A, 3B and 3C. Herein, FIG. 3A is a general view schematically illustrating the spraying apparatus. FIG. 3B is an enlarged view of a spray unit constituting the spray apparatus shown in FIG. 3A. FIG. 3C is a diagram for illustrating the flow of a lubricant in the spray apparatus shown in FIG. 3A.

This spray apparatus comprises an upper die set 31 and a lower die set 32 which are disposed to face each other; and an upper mold 33 and a lower mold 34 which are disposed on the inner side of these die sets 31 and 32, respectively. Cartridge heaters 35*a* and 35*b* are buried in the upper mold 33 and the lower mold 34, respectively. A spray robot (delivering system) 37 for spraying a lubricant 36 to these molds is placed close to the upper mold 33 and the lower mold 34. The cartridge heaters 35*a* and 35*b* are electrically connected with a heat-up unit 38 for controlling the temperature. A temperature control unit 40 is connected with thermocouples 39*a* and 39*b* which are buried in the upper mold 33 and the lower mold 34, respectively.

As shown in FIG. 3B, the spray robot 37 is equipped with a manifold 43 provided with a pipe 41 for feeding an oil type lubricant to a spray outlet and with a pipe 42 for feeding air. The manifold 43 is equipped with a needle valve 44 which is designed to be pushed by air pressure toward the right-hand in the drawing. The temperature of the upper mold 33 and the lower mold 34 can be adjusted by the heat-up unit 38 which is electrically connected with the thermocouples 39*a* and 39*b* which are buried in the molds. After the upper mold 33 and the lower mold 34 have been heated to a predetermined temperature, the lubricant 36 supplied from the spray robot 37 is sprayed on the upper mold 33 and the lower mold 34. Subsequently, a workpiece is set on the lower mold 34 to initiate the molding of the workpiece.

In FIG. 3C, a reference number 45 denotes an oil type lubricant tank, 46 denotes a pressure unit, 47 denotes a regulator, and 48 denotes a flow-meter. The oil type lubricant accommodated in the oil type lubricant tank 45 is delivered, via the regulator 47 and the flow-meter 48, to the pipe 41 by means of the pressure unit 46.

Incidentally, the delivering system is constituted by the manifold 43; the pressure unit 46 such as a pump for feeding the oil type lubricant and air respectively to the pipes 41 and 42 which are formed in the manifold 43; and the flow-meter 48. Further, the delivery condition-controlling system is constituted by the needle valve 44 of the spray unit 37, and by a driving power source (not shown) for driving the needle valve 44. Further, the temperature control system is constituted by the cartridge heaters 35*a* and 35*b*, the thermocouples 39*a* and 39*b*, the heat-up unit 38, and the temperature control unit 40.

As described above, the spray apparatus of the present invention is equipped with the delivering system 37 for spraying the oil type lubricant for forging onto the upper mold 33 and the lower mold 34; with the delivery condition-controlling system which is electrically connected with this delivering system 37 and designed to control the quantity of the oil type lubricant to be delivered from the delivering system 37; and with the temperature control system for controlling the temperature of the mold.

On the occasion of the upset-bend molding, an average bearing pressure was 120 MPa and a maximum sliding distance was 50 mm. The results of the evaluation are summarized in the above Table 8. When the same magnitude of load as applied to Comparative Example 2 for a water-soluble lubricant was applied to the workpiece of Example 3, an average thickness of the workpiece was 44.1 mm which was larger by 1.5 mm than that of Comparative Example 2. An increased plastic deformation under the same magnitude of load indicates excellence of lubricating performance (thinner workpiece). Since the thickness of the workpiece aimed at was 43-45 mm, the lubricity in Example 3 was considered practically acceptable. The quantity of spray in Example 3 was 3.2 mL which corresponded to about 1/20 of the quantity used in Comparative Example 2, indicating that even if the quantity of spray of lubricant was very small, it was possible to carry out the molding as seen in Example 3.

Further, in the case of Example 4 wherein powder was incorporated in the lubricant, the quantity of spraying was about 1/10 of the quantity used in Comparative Example 2. Although the thickness of the workpiece was 44.7 mm, it was found possible to perform the molding within the aimed thickness range of 43-45 mm for the workpiece.

The quantity of effective component, which was calculated from the ratio (mass %) of the effective component obtained through excluding volatile components in the lubricant, was 0.73 g in the case of Example 3 and 1.21 g in the case of Comparative Example, thus indicating an increased adhesive efficiency by a magnitude of about 40% in Example 3. Further, the following phenomena were observed as the features of Example 3. In the case of Comparative Example 2, the lubricity at the first shot was inferior as compared to the second shot. In the case of Example 3 however, it was possible to realize stable lubricity even in the first shot. Because of this, it is possible to prevent a defective first shot (warm-up shot) on initiating production. Thus, it was possible in the case of Example 3 to enhance the production efficiency. Further, since no solid component was included in Example 3, it was possible to prevent the staining of the region around the spray apparatus during the continuous manufacture of forged products.

Whereas, in the case of Comparative Example 2, when the molding was continuously performed, solid matters were increasingly deposited around the apparatus. Therefore, it will be required to occasionally suspend the operation and to clean the mold and the region around the apparatus. Additionally, in the case of Comparative Example 2, solid matters were precipitated to adhere onto the nozzle of the spraying spray during the waiting period of time, thereby giving rise to the unstable spray amount. As a result, the quality of product was degraded. In order to cope with this problem, it is required at present to occasionally interrupt the production to clean the nozzle. However, in the case of Example 3, since no solid matter was included therein, it was possible to prevent non-uniformity in quality of the products and the production was not required to be interrupted.

Namely, although the lubricity in Example 3 where the oil type lubricant was the same with or slightly inferior to that in Comparative Example 2, the lubricity in Example 3 was found acceptable. Prominent features of Example 3 are a great reduction of lubricant consumption and a solution of the problem caused by solid matter as in the case of Comparative Example.

(G-6) Results of Measurement-6: Evaluation with Actual Machine-B:

Table 9 below shows the results of measurement of Examples 2 and 3 and Comparative Examples 1 and 2.

TABLE 9

| | Ex. 2 | Ex. 3 | Comp. Ex. 1 | Comp. Ex. 2 |
|---|---|---|---|---|
| Quantity of spraying(mL) | 0.5 | 0.5 | 15 | 15 |
| Magnification of dilution | Undiluted liquid | Undiluted liquid | 20 times | 7 times |
| Effective component (mass %) | 34.2 | 22.8 | 21.4 | 21.1 |
| Effective component (g) | 0.17 | 0.11 | 0.16 | 0.45 |
| Molding load (ton) | 375 | 419 | 352 | 279 |
| Slide (mm) | 4.90 | 5.13 | 4.82 | 4.57 |
| Thickness (mm) | 20.22 | 20.20 | 20.21 | 20.14 |
| Difference in temp. of work before and after molding (° C.) | −45 | −36 | −54 | −50 |
| Galling and agglutination | None | None | None | None |

The conditions were as follows: the temperature of mold: 200° C.; workpiece temperature: 400° C.; and material: Aluminum No. 2000.

In addition to the evaluations obtained from the actual machine-A as set forth in paragraph G-5, the evaluation was also performed using the actual machine-B of the present applicant in order to confirm the effects of the oil type lubricant developed by the present invention. An average bearing pressure was 350 MPa and a maximum sliding distance was 40 mm. Table 9 shows the spray conditions for manufacturing a forged product having a thickness of 20.2 mm and the results of evaluation. Neither galling nor agglutination was found in both of Examples and Comparative Examples, thus making it possible to carry out the molding. However, compared with Comparative Examples, Example would have an advantage and a disadvantage. Namely, the advantage is almost no temperature decrease of the workpiece before and after the molding since there was almost no cooling effect due to the small quantity spray. As a result, it was not required to interpose the step of re-increasing the temperature in shifting the operation from the preliminary mold step to the main mold, thus making it possible to perform a continuous molding with the application of only one heating step.

Namely, Examples are suited for use in a continuous molding, which is a major characteristic of Examples. With respect to a disadvantage of Examples, the load required in the molding is relatively high. Specifically, the molding load would become higher in the order of Comparative Example 2, Comparative Example 1, Example 2 and Example 3. Namely, Comparative Example 2 is the lowest in molding load and preferable. In the case of Examples, this problem was resolved by setting a shorter distance between the upper and lower die sets to secure a thickness of 20.2 mm. As seen from Table 9, the quantity of effective component sprayed was relevant to the load required. Specifically, when the quantity of effective component is small (oil film thin) as in the case of Example 3, the load required would become higher. On the contrary, it may be assumed that, it was possible to make a production having a thickness of 20.2 mm using Comparative Example 2 with the smallest load, although the sprayed quantity of effective component was the largest.

Namely, even though Examples with the oil type lubricant was suitable for a continuous molding without accompanying galling and agglutination, a high load is required. However, according to this oil type lubricant, it is made possible to enhance the production efficiency by elimination of the re-increasing step for keeping the mold temperature, prevention of the staining of apparatus and prevention of the clogging of spray nozzle, i.e., advantages as described in paragraph G-5. Namely, it is possible to expect the enhancement of production efficiency.

(G-7) Results of Measurement-7: Summary:

Next, the advantages and disadvantages of Example of oil type lubricant over Comparative Example are described below as the summary of test results of (G-1) through (G-6).

1. Examples show more excellent adhesive efficiency. Since water is not incorporated in the lubricant, there is little possibility of Leidenfrost's phenomenon taking place and hence the adhesive efficiency of lubricant is expected to be excellent.

2. Less spray quantity is required for securing the same degree of friction and lubricity as those of Comparative Examples can be reduced to 1/10 or less. This can be attributed to the fact that the adhesive efficiency is high and also to the fact that it contains a component which is excellent in the lubricity of metal.

3. Less spray amount was also confirmed even in the assessments using a practical machine. As a result, it is possible to expect the minimization of the defect of wall-thickness reduction caused due to the residual liquid (the residue of lubricant as liquid on the surface of mold without being evaporated). Further, it is also possible to expect the reduction of the frequency of cleaning of the apparatus and the nozzle portion thereof.

4. Less temperature drop of the workpiece was observed during the preliminary molding step. Since the quantity of spraying is small, the mold can be prevented from being cooled and hence the lowering of the temperature of the workpiece during the preliminary molding can be minimized. Because of this, it may become possible to omit the step of re-increasing the temperature after the preliminary molding depending on the kinds of molding process to be used. Namely, this lubricant is suited for use in a continuous molding.

5. Almost the same degree of lubricity as that of Comparative Examples was observed in the ring compression test under high pressures. On the other hand, in the case of the actual machine, the molding load was slightly higher than that of Comparative Examples. This may be presumably attributed to the fact that the quantity of spraying was very small.

6. Less amount of materials deposition on the apparatus and the mold were observed. This was attributed to the fact that the lubricant contains no solid matter. Therefore, it is possible to reduce the frequency of cleaning of the apparatus and the region around it, thus enhancing the production efficiency.

7. More stable spray and no clogging of spray nozzle were performed due to no solid matters in the oil type lubricant. As a result, the following effects can be expected. The water-soluble lubricant causes soldering and sticking problems of workpiece resulted from thinner oil film formation which is led by the decreased quantity of spray due to the clogging of nozzle. Further, the water-soluble lubricant has frequently caused another problem of shut down of fluid flow due to the deposition of the solid matters at a valve portion. Because of this problem, the defect of wall-thickness reduction frequently occurred due to too much lubricant spray. Since the oil type lubricant contains no solid matter, these problems can be avoidable, thereby making it possible to enhance the production efficiency. Meanwhile, it has been confirmed that even if a little amount of lipophilicity-imparted white powder is mixed into the lubricant, it is possible to secure the moldability. When the quantity of the white powder is limited, the contamination of the working environment can be reduced as compared with the conventional lubricants. Further, since the powder is imparted with lipophilicity, it is excellent in dispersancy and hence the deposition thereof on the valve portion would be minimized.

8. Since the quantity of spray is small, it is possible to shorten the cycle time. Even though it is a ripple effect, no water in the lubricant makes it possible to expect a greatly prolonged useful life of the mold through the minimization of cooling and thermal fatigue of the mold.

9. Because of excellence in high-temperature lubricity, it is possible to increase the temperature of the mold. As a result, when a large number of steps are required in the molding, it is possible to lower the molding load in subsequent steps, thereby making it possible to prolong the useful life of mold after the second step.

10. Since the lubricant contain no water, any drainage treatment is no longer required.

11. Due to the improvement of the spray method, it is now possible to realize uniform spray and small quantity spray. As a result, various effects can be exhibited, thus making it possible to expect synergistic effects thereof in combination with the effects set forth in paragraphs 1-10. Additionally, in the case of actual machine-B evaluation, it was possible to omit the step of re-increasing the temperature prior to the main molding.

12. As a further merit of the oil type lubricant developed by the present invention, it is now made possible to reduce the frequency of replenishing the lubricant and to omit the stirring of a storage tank because of no solid matters in the lubricant.

The oil type lubricant of the present invention is suited for spraying on the occasion of performing the forging of non-iron metals or iron and also suited for lubricating the surface of a mold. Further, this oil type lubricant is also applicable to the drawing work wherein an oil-type lubricant is used.

What is claimed is:

1. An oil type lubricant for forging, which comprises:

(a) 60-90 mass % of solvents having a kinematic viscosity of 2-10 $mm^2/s$ at 40° C. and a flash point of 70-170° C.;

(b) 1-5 mass % of mineral oils having a kinematic viscosity of 50 to less than 100 $mm^2/s$ at 40° C.;

(c) 1-5 mass % of an ester base oil having a kinematic viscosity of not less than 200 $mm^2/s$ at 40° C.;

(d) not more than 15 mass % of silicone oils having a kinematic viscosity of not less than 150 $mm^2/s$ at 40° C.;

(e) 5.1-10 mass % of additives exhibiting a lubricity; and (f) 0 mass % of water, wherein the mineral oils is selected from the group consisting of petroleum-based mineral oil and cylinder oil, and the ester base oil is selected from the group consisting of diester, triester, trimelliate ester and complex ester.

2. The oil type lubricant for forging according to claim 1, which further comprises 0.1-3 mass % of wettability improvers.

3. The oil type lubricant for forging according to claim 2, which further comprises antioxidants.

4. The oil type lubricant for forging according to claim 3, wherein the antioxidants are contained at a ratio of 0.2-2 mass % and is formed of one or more kinds of antioxidants selected from the group consisting of an amine-based antioxidant, a phenol-based antioxidant and a cresol-based antioxidant.

5. The oil type lubricant for forging according to claim 3, which further comprises 1-5 mass % of lipophilicity-imparted white powders.

6. A forging method which is characterized in that the forging is performed using the oil type lubricant for forging set forth in claim 1.

7. A spray apparatus which is characterized in that it comprises a delivering system for spraying an oil type lubricant for forging to a mold, the oil type lubricant in claim 1; a delivery condition-controlling system which is electrically connected with the delivering system and designed to control the quantity of the oil type lubricant to be delivered from the delivering system; and a temperature control system for controlling the temperature of the mold.

* * * * *